United States Patent [19]

Murakami

[11] 4,058,044

[45] Nov. 15, 1977

[54] ELECTRICAL MUSICAL INSTRUMENT

[75] Inventor: Kazuo Murakami, Hamamatsu, Japan

[73] Assignee: Nippon Gakki Seizo Kabushiki Kaisha, Japan

[21] Appl. No.: 590,557

[22] Filed: June 26, 1975

[30] Foreign Application Priority Data

| | | |
|---|---|---|
| June 29, 1974 | Japan | 49-74882 |
| Oct. 7, 1974 | Japan | 49-114673 |
| June 29, 1974 | Japan | 49-76699[U] |
| June 29, 1974 | Japan | 49-76701[U] |

[51] Int. Cl.[2] ..... G10H 3/00; G10H 3/08

[52] U.S. Cl. ..... 84/1.14; 84/1.15; 84/403; 84/454; 84/DIG. 18; 84/DIG. 21

[58] Field of Search ..... 84/1.04, 1.06, 1.08, 84/1.14, 1.15, 423, 433–436, 454, DIG. 7, DIG. 18, DIG. 21, DIG. 24, 351, 363, 365, 402–405

[56] References Cited

U.S. PATENT DOCUMENTS

| | | | |
|---|---|---|---|
| 2,339,971 | 1/1944 | Zimmerman | 84/403 |
| 2,559,334 | 7/1951 | Alexander | 84/403 X |
| 2,799,196 | 7/1957 | Alvarez | 84/1.04 |
| 2,844,986 | 7/1958 | Boda | 84/405 |
| 2,901,936 | 9/1959 | Scherer et al. | 84/1.04 |
| 3,215,765 | 11/1965 | Miessner | 84/1.06 |
| 3,418,417 | 12/1968 | Rhodes | 84/1.15 |
| 3,622,681 | 11/1971 | Hopping | 84/1.06 X |

*Primary Examiner*—Stanley J. Witkowski
*Attorney, Agent, or Firm*—Flynn & Frishauf

[57] ABSTRACT

An electrical musical instrument is provided with a tone generator comprising a plurality of vibratory tone bars each supported with its both ends free. The tone bars are struck by key-actuated hammers and the vibration of each tone bar is picked up by a mechanical-electrical transducer associated with the tone bar. With such tone generator, the tone produced by the musical instrument of this invention is very much improved, especially in that the tone is rich in a solid and percussive constituent.

22 Claims, 23 Drawing Figures

ELECTRICAL MUSICAL INSTRUMENT

BACKGROUND OF THE INVENTION

1. Field of the Invention

This invention relates to an electrical musical instrument, particularly to an electric piano provided with an improved tone generator.

2. Description of Prior Art

Generally, an electric piano comprises a series of keys, hammers swung by depression of the keys through an action mechanism, resonators to vibrate with their natural frequencies when hit by the hammers, pickups to pick up electromagnetically the frequencies of the resonators, and a loudspeaker to output the frequencies picked up by the pickups and thereafter amplified by an amplifier.

The resonators used in the conventional electric pianos are fork-shaped, or have a modified fork shape as in U.S. Pat. No. 2,972,922 and U.S. Pat. No. 3,644,656. Or they comprise cantilevered tabular reeds, as in U.S. Pat. No. 2,934,988. The musical tones produced by such conventional electric pianos, however, are not at all satisfactory, because they are very simple and monotonous. They are especially deficient in solidness and percussiveness. Further, any of the prior art resonator of an electric piano has not satisfied, for example, the following requirements demanded thereof: it is prominently durable, facilitates tuning, saves tuning from derangement over a long period, attains the easy adjustment of overtones, provides suitable growth and decay characteristics and is readily attached to or detached from the mount for retuning or the exchange of the resonator.

The conventional electric piano has still a further defect in that the produced sound contains undesirable noise inevitably because the pickups fixed directly onto the mount pick up unnecessary vibration outside the piano via the mount or unnecessary vibration of the mount caused by the reeds.

SUMMARY OF THE INVENTION

An object of this invention is to provide an electrical musical instrument in nature of piano provided with a tone generator which produces an improved musical sound having a prominent feature in its rising characteristics.

Another object of this invention is to provide an electric piano, having vibratory tone bars supported with their both ends free, which can produce percussive and solid musical sounds.

Still another object of this invention is to provide an electric piano provided with supports which can support the respective tone bars, without affecting the resonance characteristics of the tone bars.

A further object of this invention is to provide an electric piano in which the pickups pick up only the frequencies of the tone bars but not undesirable vibration, so that the loudspeaker never gives forth undesirable noises.

A still further object of this invention is to provide an electric piano having a tone generator which can easily be attached to and detached from the piano framing.

An electrical musical instrument in the nature of piano (hereinafter referred to as an "electric piano") includes a tone generator which comprises vibratory tone bars arranged side by side on a horizontal plane in the order of a scale of musical notes, pickups each so disposed as to face one end of the respective tone bar and adapted to detect the resonant frequency of the tone bar, supports for elastically holding tone bars at their two nodal points, and a mount for carrying the pickups and the supports. Beneath the middle portions of the tone bars there are arranged the same number of hammers as the tone bars. The hammers are rockably supported on the action mechanism of the electric piano and selectively rocked to hit the associated tone bars when actuated by the depression of the associated keys through the action mechanism. Thus, the vibratory tone bars are selectively hit and vibrated with their natural resonant frequencies.

Each support of the tone generator comprises an elastic pad having an upper portion with a triangular cross-section the apex ridge of which contacts and supports the fundamental nodal point of the respective tone bar, a threaded pin with a head penetrating the fundamental nodal point of the tone bar and the central portion of the pad and being fixed to the mount at its lower end, and a damping member interposed between the tone bar and the head of the pin.

The mount of the tone generator has two first frame members to hold the supports for supporting nodal points of the tone bars, a second frame member to hold the supports for supporting the pickups, and the third frame member to support the first and second frame members. Between the first and second frame members and the third frame member damping members are inserted to prevent any undesirable vibration from being transmitted to the pickups through the third frame member, thus avoiding giving forth noises from the loudspeaker.

DESCRIPTION OF THE PREFERRED EMBODIMENTS

Figure 1:
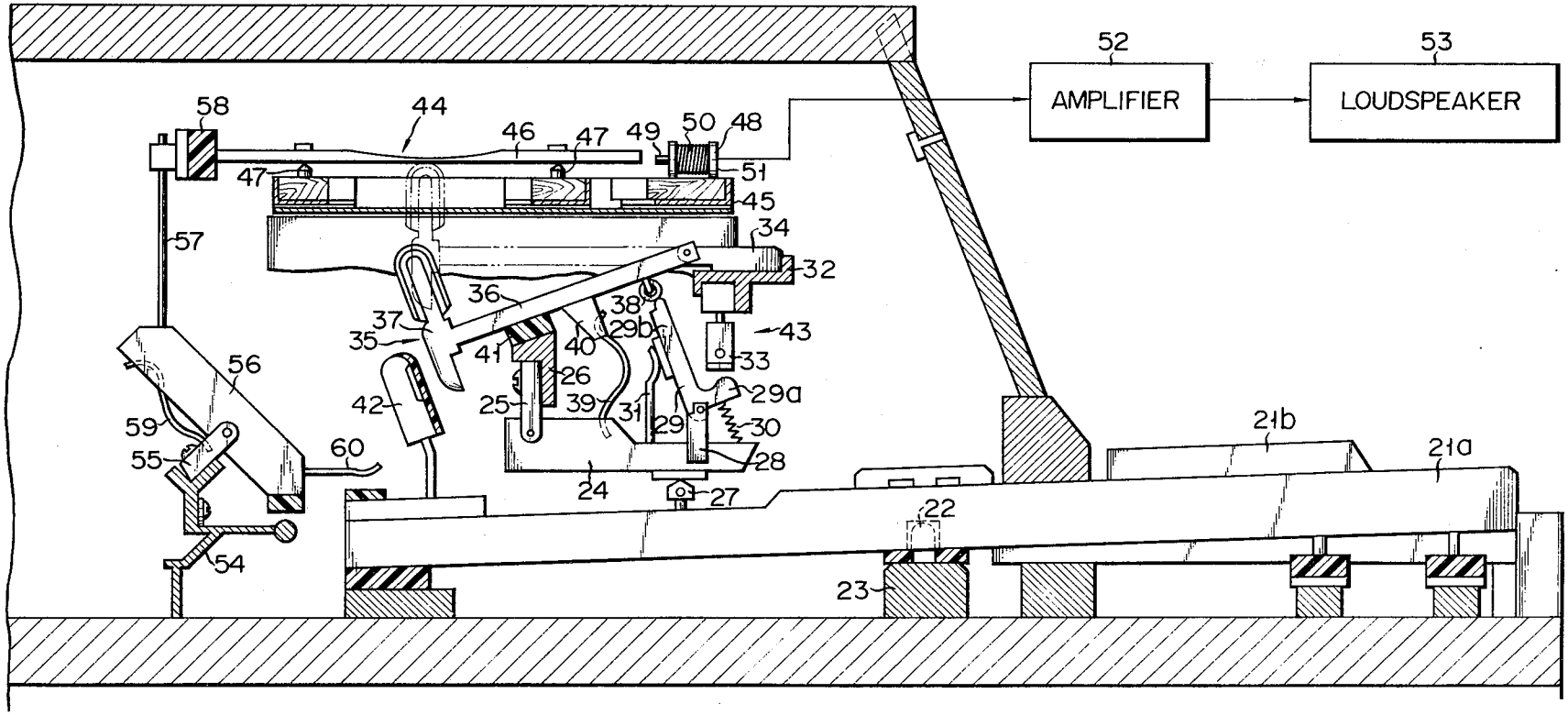
FIG. 1 is a partial side view, in cross section, of one embodiment of the electric piano according to this invention.

Referring to FIG. 1, an electric piano according to this invention is provided with a plurality of keys 21*a* and 21*b* (reference numeral 21*a* indicating a natural key and 21*b* indicating a sharp and flat key) arranged side by side, each extending rearwardly of the piano on a substantially horizontal plane. Each of the keys 21*a* and 21*b* is made rockable up and down about a balance pin 22 protruding upward from a horizontal rail member 23 which extends in the transverse direction of the piano. There are provided as many wippens 24 as the keys 21*a* and 21*b*. Each of the wippens 24 is pivoted at its rear end to the lower end of a wippen flange 25 secured to a central rail 26 which extends in the transverse direction of the piano and is fixed to the framing of the piano. The wippen 24 contacts at its front end portion of underside with a capstan 27 fixed to the upper surface of the corresponding key 21*a* or 21*b* between the middle and rear end thereof. A jack flange 28 extends upward from the front end of each wippen 24. To the top portion of the jack flange 28 a jack 29 in the form of a bell crank is pivoted at its central portion. The jack 29 is always urged counterclockwise in FIG. 1 by a compression spring 30 interposed between an arm 29*a* of the jack 29 and the front end portion of the wippen 24. The other arm 29*b* of the jack 29 is pressed against a spoon 31 protruding from the wippen 24, when the corresponding key 21*a* or 21*b* is in its inoperative position.

Above the arm 29*a* of the jack 29, a hammer rail 32 extends in the transverse direction of the piano and is secured to the piano framing. From the hammer rail 32 a regulating member 33 is suspended, and on the hammer rail 32 the same number of hammer flanges 34 as the keys 21*a* and 21*b* are secured. Hammers 35 each comprises a hammer stem 36 pivoted at one end on the respective hammer flange 34 and a hammer head 37 fixed to the other end of the hammer stem 36. To a portion of the stem 36 which is near the hammer rail 32, a roller 38 is attached so as to abut against the top of the arm 29*b* of the jack 29 when the corresponding key 21*a* or 21*b* is in its inoperative position, thereby holding the hammer 35 in the position depicted in FIG. 1, i.e. in the stationary position. A leaf spring 39 has its lower end secured to the wippen 24, and its upper end receives an extension 40 provided on the central portion of the stem 36. On the upper surface of the central rail 26 a hammer damper 41 is mounted, and behind each hammer head 37 there stands a back check 42 of well-known type used in the conventional electric piano. An action mechanism 43 comprises the members 27 to 29, 29*a*, 29*b* and 30 to 42.

Above from the action mechanism is dispersed a tone generator 44 which comprises a mount 45 secured to the framing of the piano, a plurality of tone bars 46 made of metal or other magnetic materials, positioned on the paths along which the hammer heads 37 move, supports 47 supporting the fundamental nodal points of the respective tone bars 46, and mechanical electrical transducers or electromagnetic pickups 48 positioned in front of the respective tone bars 46 and mounted on the mount 45. Each tone bar 46 is supported by the supports 47 with its both ends free. The structure and function of the tone generator 44 will be detailed later.

Each of the electromagnetic pickups 48 comprises a normally stationary permanent magnet 49 facing the front end of the corresponding tone bar 46 and which is adjustably movable in the lengthwise direction of the tone bar 46, a coil 50 wound around the permanent magnet 49, and a casing 51 fixed to the mount 45. Permanent magnet 49 is movable toward and away from the front end of the tone bar 46 to adjust for the best vibration pick up efficiency. The coil 50 is connected to a loudspeaker 53 through an amplifier 52.

At the back of the rear ends of the keys 21*a* and 21*b* there is provided a support frame 54, to which arms 55 are secured. On the upper end of each arm 55 a damper lever 56 is pivoted substantially at its middle portion. From the upper end of the lever 56 there extends upward a rod 57 having a damper 58 fixed to its upper end. A leaf spring 59 has its one end fixed to the arm 55, and its other end presses the upper backside of the lever 56 so as to urge the lever 56 always in the clockwise direction. Consequently, the damper 58 abuts against the rear end of the corresponding tone bar 46 as shown in FIG. 1 when the corresponding key 21*a* or 21*b* is in its inoperative position. As the key 21*a* or 21*b* is depressed, a damper spoon 60 extending from the lower end toward the front of the piano is pushed up by the rear end of the corresponding key 21*a* or 21*b* and rocks the lever 56 counterclockwise against the urging force of the spring 59 thereby causing the damper 58 to retreat from the rear end of the corresponding tone bar 46.

Suppose the key 21*a* or 21*b* is depressed. Then the corresponding wippen 24 is abruptly rocked counterclockwise by the key 21*a* or 21*b* through the capstan 27, and the jack 29 is also abruptly moved upward to swing the hammer clockwise through the roller 38. As a result, the hammer head 37 moves to the position indicated by two-dot chain lines in FIG. 1 and hits the underside of the corresponding tone bar 46 at the middle portion, thereby vibrating the tone bar 46 with its natural frequency. In the meantime, the damper 58 is retreating from the rear end of the tone bar 46 by the key 21*a* or 21*b* through the spoon 60, the lever 56 and the rod 57 during the depression of the key 21*a* or 21*b*. Thus the damper 58 does not hold the tone bar 46 from free vibration. The vibration of the tone bar 46 is detected or picked up by the corresponding pickup 48 and is converted to electric signals. The electric signals are amplified by the amplifier 52 and then transformed by the loudspeaker 53 into musical sounds.

The jack 29 rises by the depression of the key 21*a* or 21*b* until its arm 29*a* contacts the lower end of the regulating member 33. As the jack 29 rises further, the regulating member 33 rocks the jack 29 clockwise, thereby moving the arm **29*b* out of the path of the corresponding roller 38. After hitting the tone bar 46, the hammer 35 swings counterclockwise by its own weight, and the stem 36 is elastically received by the hammer damper 41, the head 37 by the back check 42, and the extension 40 by the leaf spring 39. When the hammer 35 returns to its inoperative position, the key 21*a* or 21*b* is still depressed. Accordingly the jack 29 is still in rocked state in the clockwise direction, and its arm 29*a* does not come into an undesirable collision with the roller 38**.

When the key **21*a* or 21*b* returns to its inoperative position, the jack 29 is lowered as the wippen 24 rocks clockwise, and its arm 29*a* is released from the regulating member 33. Once the arm 29*a* is freed from the regulating member 33, the jack 29 is rocked counterclockwise by the spring 30 until the arm 29*b* contacts the spoon 31. Then, the arm 29*b* comes into engagement with the roller 38 again. Consequently, the action mechanism 43 is brought back to the inoperative position as shown in FIG. 1. In the meantime, the lever 56 is also rocked clockwise by the spring 59 to make the damper 58 come again into contact with the rear end of the tone bar 46, thus stopping the vibration of the tone bar 46**.

Figure 2:
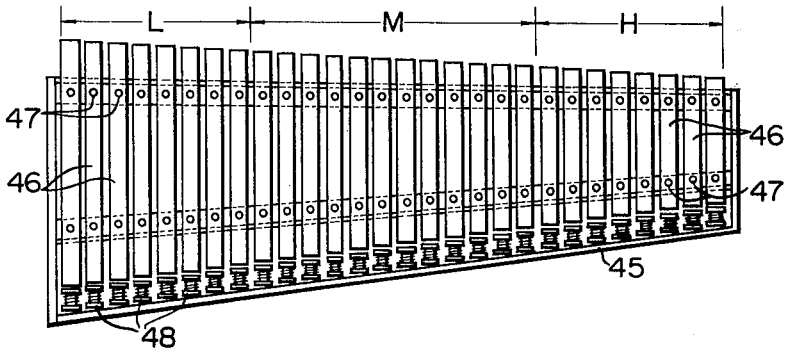
FIG. 2 is a plan view of the tone generator shown in FIG. 1.

The tone generator 44 will now be explained in detail. FIG. 2 is a plan view of the tone generator 44, in which the tone bars 46 are arranged side by side in the order of a scale of a musical notes corresponding to the plurality of keys **21*a* and 21*b***, the extremely right one being of the highest pitch and the extremely left one being of the lowest pitch, and are grouped into those of low pitch (bass tone) region L, those of middle pitch (middle tone) region M and those of high pitch (treble tone) region H.

When a tone bar with a uniform cross-section, a uniform density and a uniform Young's modulus over its entire length is vibrated with both ends made free, the frequency Vn at n-th harmonic is given by the following equation:

$$Vn = 1/2\pi(2Xn^2/l)\cdot t/\sqrt{12}\cdot\sqrt{E/\rho} \quad (1)$$

where $l$ denotes the length of the tone bar, $t$ the thickness, E the Young's modulus, $\rho$ the density, and $Xn$ a constant specific to the n-th harmonic.

Figure 3:
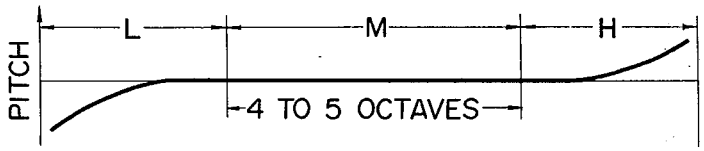
FIG. 3 shows the tuning characteristics of tone bars throughout the tonal region which are required of the electric piano according to this invention.

Accordingly, if all the tone bars 46 have the same uniform cross-section and made of the same material, any desired natural frequencies are determined only by their lengths. But the tone bars of the low pitch region L become too long to be housed in the electric piano cabinet if they have the same uniform cross-section as the tone bars of the other pitch regions M and H. Accordingly, in such instance, the thickness is made smaller at the low pitch region than at the other regions. Generally, the pitches of theoretical value (i.e. standard pitches) of piano strings of the middle pitch region M are audible to listeners as sounds of the same pitches, but the pitches of the strings of the high and low pitch regions cannot sound as sounds of the same pitches unless the strings of the high pitch region are so tuned as to have pitches a little higher than the theoretical values (or standard pitches) and those of the low pitch region are so tuned as to have pitches a little lower than the theoretical values. In the electric piano according to this invention, the tone bars 46 of the middle pitch region M ranging 4 to 5 octaves are made to have the standard pitches as illustrated in FIG. 3. However, the tone bars 46 of the high pitch region H should be tuned to have pitches gradually higher than the standard pitches and the tone bars 46 of the low pitch region L should be turned to have pitches gradually lower than the standard pitches.

Figure 4A:
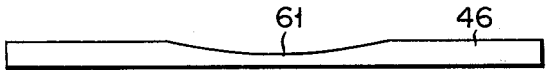
FIGS. 4A, 4B and 4C show tuning means for the tone bars of middle tone region, the tone bars of bass tone region and the tone bars of treble tone region, respectively.
Figure 4B:
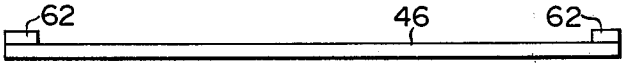
Figure 4C:
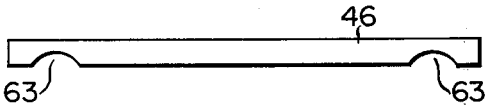

Although the tone bars 46 used in this invention each have a substantially uniform cross-section, they are shaped as follows so as to attain a precise tuning. The tone bars 46 of the middle pitch region are made shorter than required by equation (1) and have a large depression portion 61 as shown in FIG. 4A so that they obtain the desired pitches and overtones. The tone bars 46 of the low pitch region L are made thinner by allowing them to be shorter, as shown in FIG. 4B, to obtain the standard pitches and are attached with weight members 62 at both ends so that their pitches are regulated to the required lower one than the standard pitches. The tone bars 46 of the high pitch region H have each two depressed portions 63 at both end portions as illustrated in FIG. 4C so that their pitches are adjusted to the required higher one than the standard pitches. Thus, the depressed portion 61 of each tone bar 46 of the middle pitch region M, the depressed portion 63 of each tone bar 46 of the high pitch region H, and the weight members 62 of each tone bar 46 of the low pitch region L constitute tuning means.

Figure 5:
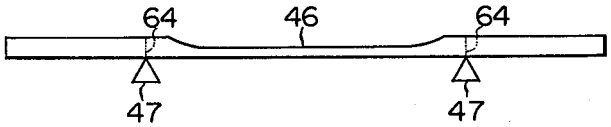
FIG. 5 schematically illustrates how to support each tone bar.

Each of the tone bars 46 so formed as mentioned above is supported by the supports 47 at the portions where its fundamental nodes 64 exist, as schematically shown in FIG. 5.

Figure 6:
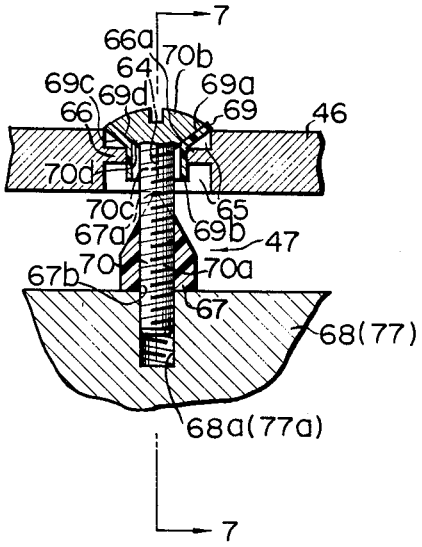
FIG. 6 is a cross-sectional view of an embodiment of the tone bar support according to this invention.
Figure 7:
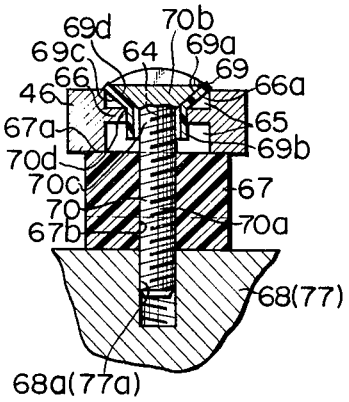
FIG. 7 is a cross-sectional view of the support taken along the line 7—7 of FIG. 6.

FIGS. 6 and 7 show an embodiment of the support 47. A tone bar 46 has two apertures 65 the centers of which accord with the respective fundamental nodes 64. Formed in each aperture 65 is a ring-shaped shoulder 66 extending toward the center of the aperture 65. A damping member (or a pad) 67 for the tone bar 46 made of rubber or elastic plastic material is mounted on the upper surface of a horizontal frame member 68 (or 77) of a mount 45 (hereinafter described in detail). The upper end of the damping member 67 has a triangular form and V-shape in cross-section, the apex ridge of which runs across the tone bar 46, and is kept in contact with the underside of the tone bar 46 just below the fundamental node 64. Into the shoulder 66 there is inserted the tube portion **69*b* of a funnel-shaped sleeve 69 made of rubber, elastic plastic material or the like. The outer surface 69*c* of the cone portion 69*a* of the sleeve 69 is in contact with the upper edge 66*a* of the shoulder 66. Through the sleeve 69, the threaded portion 70*a* of a bolt (or threaded pin) 70 penetrates the shoulder 66 and the central portion of the damping member 67, and the lower end of the bolt 70 is fixedly screwed into a female thread 68*a* (or 77*a*) formed in the horizontal frame member 68 (or 77) of the mount 45. The underside 70*d* of the head 70*b* of the bolt 70 contacts the inner peripheral surface 69*d* of the cone portion 69*a* of the sleeve 69, thereby lightly pressing the shoulder 66 downward to ensure the positioning of the tone bar 46. The neck portion 70*c* of the bolt 70 is loosely fitted in the tube portion 69*b* of the sleeve 69, so that the tone bar 46 can move up and down, being controlled by the resilient force of the damping member 67**.

In the embodiment of FIGS. 6 and 7, when the tone bar 46 is vibrated, the fundamental nodes 64 does not move. Accordingly, that portion of the bar 46 which is near the fundamental nodes 64 vibrates with an extremely small amplitude. Since the support 47 supports the tone bar 46 elastically and the apex ridge **67*a* of the damping member 67 is positioned right below the node 64, making a line contact with the tone bar, that portion of the tone bar 46 which touches the apex ridge 67***a* can freely be vibrated. Further, the bolt 70 prevents any horizontal movement of the tone bar 46. As a result, the tone bar 46 can be held by the support 47 at its prescribed position and also its frequency characteristic can remain unchanged.

Figure 8:
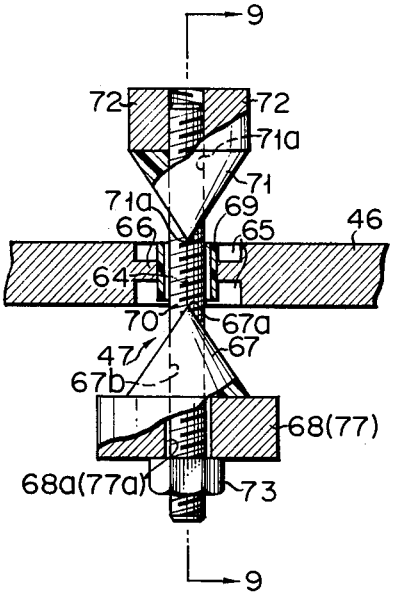
FIG. 8 is a cross-sectional view of another embodiment of the tone bar support according to this invention.
Figure 9:
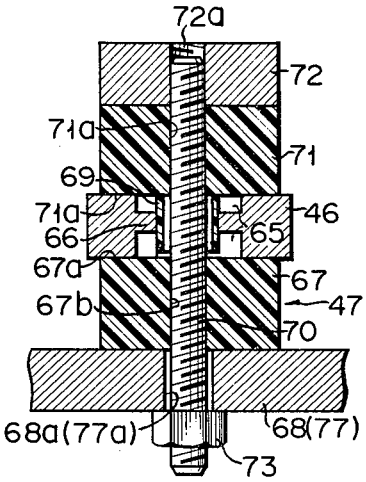
FIG. 9 is a cross-sectional view of the support taken along the line 9—9 of FIG. 8.

FIGS. 8 and 9 show another embodiment of the support 47 on the mount 45. In a tone bar 46 two apertures 65 are formed at its fundamental nodes 64. In each aperture 65 is provided a ringshiped shoulder 66 extending to the center of the aperture 65. In these respects this embodiment is identical with that illustrated in FIGS. 6 and 7. There are provided an upper damping member (or pad) 71 and a lower damping member (or pad) 67 each made of elastic material such as rubber or elastic plastics and having a triangular cross-section and thus an apex ridge as shown in FIG. 8. The apex ridges 71*a* and 67*a* of these damping members 71 and 67 sandwich those upper and lower surface portions of the tone bar 46 over and under of which one of the fundamental nodes 64 lies. The tone bar 46 makes a line contact with each of the damping members 67 and 71. A bolt (or threaded pin) 70 penetrates a sleeve 69 inserted in the shoulder 66 and thus is loosely fitted in the shoulder 66. It further penetrates a hole 71*a* of the upper damping member 71 and a hole 67*b* of the lower damping member 67 and then a hole 68*a* (or 77*a*) of the horizontal frame member 68 (or 77). Its upper end is screwed into the female thread 72*a* of a head 72 mounted on the upper damping member 71, while its lower end is screwed into a nut 73 on the under surface of the horizontal member 68 (or 77), whereby the upper and lower damping members 72 and 67 are pressed against the tone bar 46 by the bolt 70, the head 72 and the nut 73. According to the support structure of this embodiment, the free vibration of the tone bar is much facilitated and the generation of possible noises would be reduced, while the attachment of the tone bar to the support is tightly secured.

Figure 10:
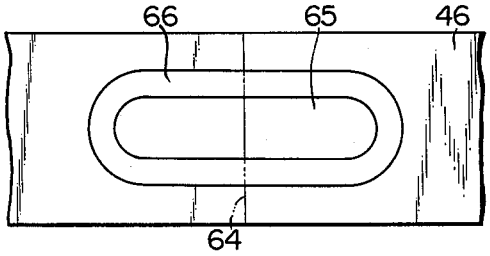
FIG. 10 is a plan view of that portion of a modified tone bar.

FIG. 10 shows a modified embodiment of the aperture formed at the fundamental node 64 of the tone bar 46 and of the ring-shaped shoulder extending toward the center of the aperture. In this embodiment, the aperture 65 differs from the circular one in the embodiment of FIGS. 6 to 9 in that it is semi-elliptical and extends in the lengthwise direction of the tone bar 46. Similarly, the shoulder 66 is a semi-elliptical ring and extends in the lengthwise direction of the tone bar 46. The semi-elliptical aperture 65 and the semi-elliptical shoulder 66 allow very easy adjustment of the positions of the supports 47 of FIGS. 6 to 9 relative to the tone bar 46, thus facilitating the tuning of the tone bar 46.

Figure 11:
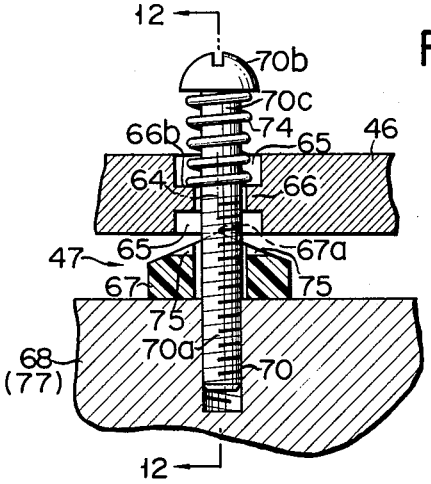
FIG. 11 shows another embodiment of the tone bar support according to this invention.
Figure 12:
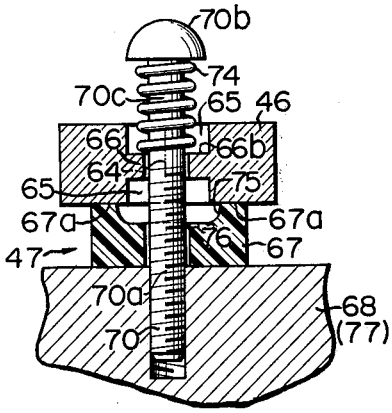
FIG. 12 is a cross-sectional view of the support taken along the line 12—12 of FIG. 11.

FIGS. 11 and 12 show still another embodiment of the support 47. This embodiment is provided, in place of the sleeve 69 used in the embodiment of FIGS. 6 and 7, a helical coil spring 74 which surrounds the neck portion 70*c* of a bolt (or threaded pin) 70 and which is interposed between the head 70*a* of the bolt 70 and the upper face 66*b* of an inwardly extending, ring-shaped shoulder 66 positioned at middle depth in an aperture 65 formed at the fundamental node 64 of a tone bar 46. Being so disposed, the helical coil spring 74 elastically presses the tone bar 46 downward, and its function is similar to that of the upper damping member 71 in the embodiment of FIGS. 8 and 9. The threaded portion 70*a* of the bolt 70 is loosely fitted in the shoulder 66. The top portion of an elastic damping member (or pad) 67 has a triangular form or V-shape in cross-section and has a depression 75 in the central part. Thus only the apex ridges 67*a* at both sides of the top portion are in line contact with the under surface of the tone bar 46. This means that the contacting area of the damping member 67 with the tone bar 46 is so small that the support 47 affects the vibration characteristic of the tone bar 46 far less than otherwise.

Moreover the damping member 67 has a hole 76 the diameter of which is larger than the outer diameter of the threaded portion 70*a* of the bolt 70. The threaded portion 70*a* can therefore pass through without touching the inner wall of the hole 76. Thus, the damping member 67 is free from contact with the bolt 70 and thereby to remain the vibration characteristic of the tone bar 46 unchanged.

Figure 13:
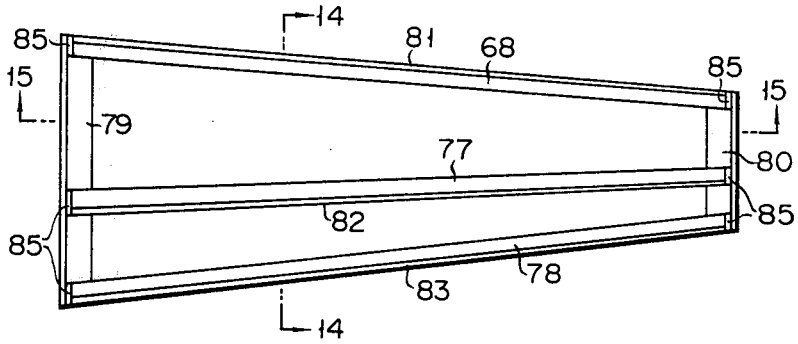
FIG. 13 illustrates an embodiment of the amount used in the tone generator according to this invention.
Figure 14:
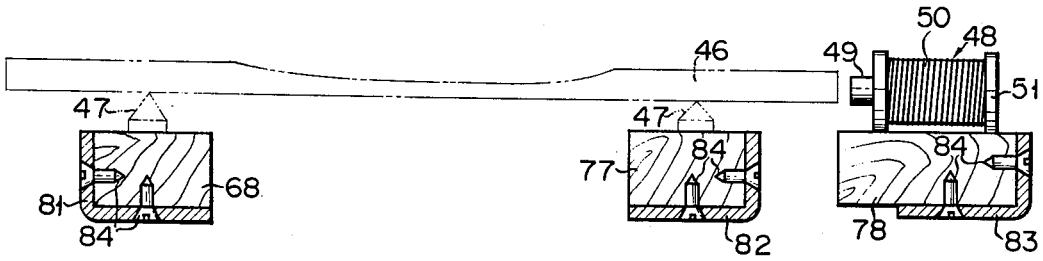
FIG. 14 is a cross-sectional view of the mount taken along the line 14—14 of FIG. 13.
Figure 15:
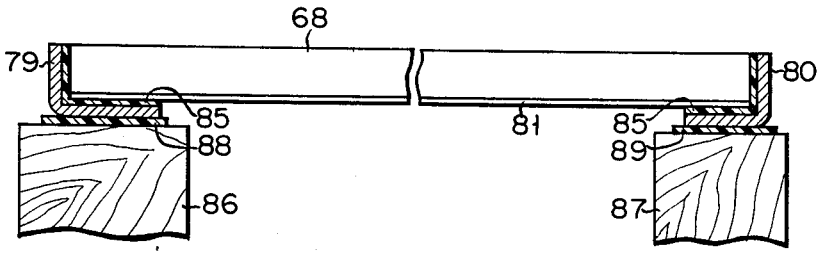
FIG. 15 is a cross-sectional view of the mount taken along the line 15—15 of FIG. 13.

FIGS. 13 to 15 show an embodiment of a mount 45. As illustrated in FIG. 13, the mount 45 comprises horizontal frame members 68 and 77 for supporting respectively the first and second nodal portions of each tone bar 46, a horizontal frame member 78 for holding the pickups 48, and horizontal end frames 79 and 80 which are metal angle bars, while the horizontal frame members 68, 77 and 78 are generally made of wood.

As shown in FIG. 14, the horizontal frame members 68, 77 and 78 are fixed with screws 84 to angle bars 81, 82 and 83, respectively, and through these angle bars 81, 82 and 83 they are connected to the horizontal end frames 79 and 80 at both ends (FIG. 13). Between the horizontal end frames 79 and 80 and the ends of the angle 81, 82 and 83 there are interposed damping sheet elements 85 which prevent the vibration of the tone bar 46 from being picked up as noises by the pickups 48 through the horizontal frame members 68, 77 and 78, the angle bars 81, 82 and 83, and the horizontal end frames 79 and 80 (FIG. 15). Further, the horizontal end frames 79 and 80 are mounted on blocks 86 and 87 through damping sheet elements 88 and 89 as illustrated in FIG. 15, thus preventing noises from being detected by the pickups 48 through the blocks 86 and 87.

Figure 16A:
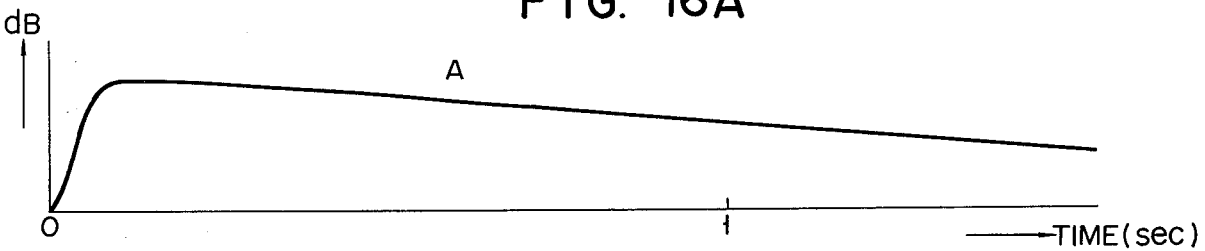
FIG. 16A shows the growth and decay characteristics of the musical sounds produced by the electric piano according to this invention.
Figure 16B:
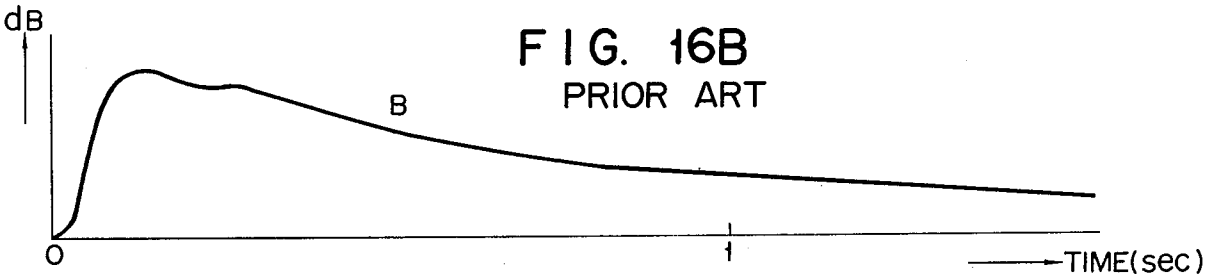
FIG. 16B PRIOR ART
FIG. 16B shows the growth and decay characteristics of the musical sounds obtained by a conventional electric piano.
Figure 16C:
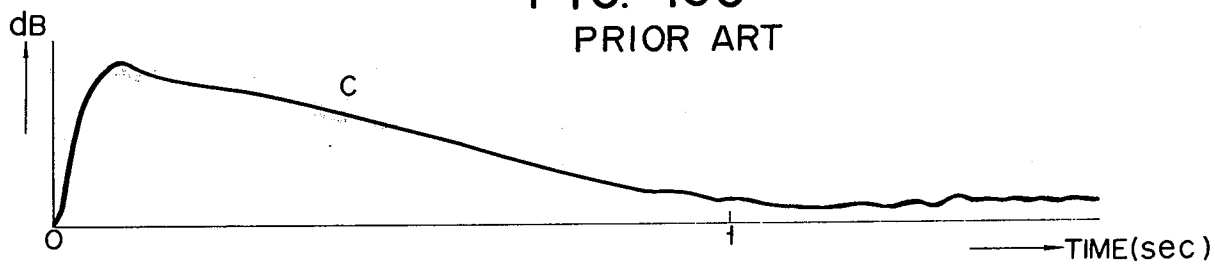
FIG. 16C PRIOR ART
FIG. 16C shows the growth and decay characteristics of the musical sounds produced by an ordinary piano.

Curve A in FIG. 16A shows the growth and decay characteristics of a tone produced by the electric piano according to this invention, curve B in FIG. 16B that of such an electric piano as disclosed in U.S. Pat. No. 3,154,997, and curve C in FIG. 16C that of a conventional mechanical piano. The comparative study of these curve proves that the musical sounds produced by the electric piano according to this invention decays less than that of sounds produced by the conventional electric and mechanical pianos and that the decay occurs much more slowly in the electric piano according to this invention than the conventional electric and mechanical pianos.

Figures 17A, 17B, 17C:
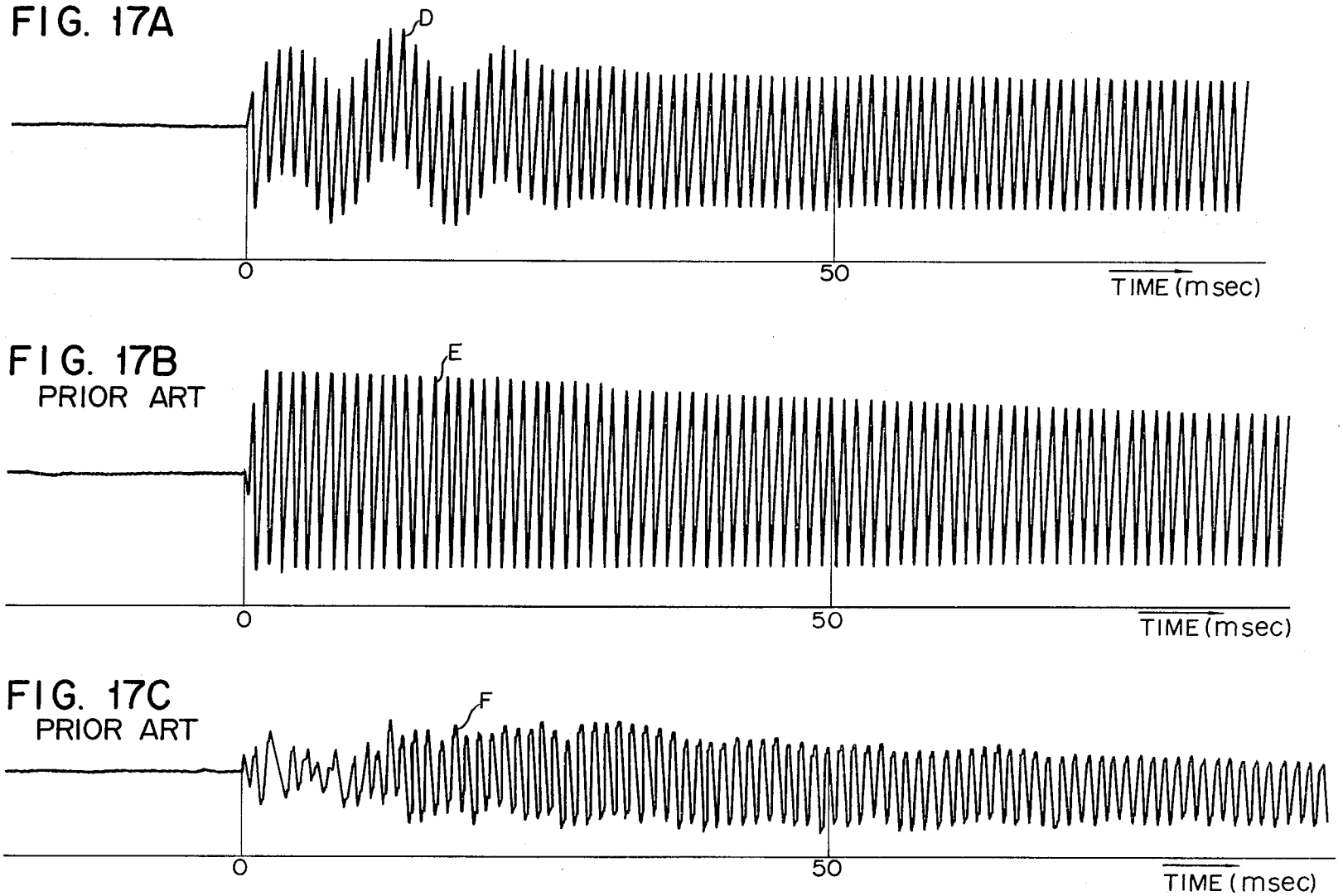
FIG. 17B PRIOR ART
FIG. 17C PRIOR ART
FIG. 17A shows the waveform characteristic of a sound produced by the electric piano according to this invention, recorded for a short time after the hitting of the respective tone bar.
FIG. 17B shows the waveform characteristic of a sound produced by the conventional electric piano, recorded for the same time period as in FIG. 17A.
FIG. 17C shows the waveform characteristic of a sound produced by the ordinary piano, recorded for the same time period as in FIG. 17A.

Curve D in FIG. 17A shows the waveform characteristic of a sound produced by the electric piano of this invention, recorded for a short time after the hitting of the tone bar, curve E in FIG. 17B that of a sound produced by the conventional electric piano, and curve F in FIG. 17C that of a sound produced by the conventional mechanical piano.

In the present invention, the envelopes of curve D in FIG. 17A make sine curves for a short time immediately after the hitting of the tone bar, while those of curve E in FIG. 17B are flat. Further, curve D is not affected by undesirable overtones, as the curve E in FIG. 17C is affected severely in particular right after the hitting of the tone bar. In consequence of this, it is to be understood that the electric piano according to this invention can produce musical sounds far more percussive and solid than those produced by the conventional electric and mechanical pianos.

What is claimed is:

1. An electrical musical instrument including:

a plurality of vibratory tone bars arranged side by side in the order of a musical scale, said tone bars having apertures therein.

supporting means for supporting each of said tone bars at their respective nodal points with both ends of each of said tone bars left free, said supporting means for each of said tone bars comprising a pin having a head at one end, said pin being loosely fitted at the middle portion thereof in an aperture of a tone bar at one of the nodal points thereof, a first damping member elastically engaging that portion of one surface of said tone bar which corresponds to one of the nodal points, and a second damping member elastically engaging that portion of the opposite surface of said tone bar which corresponds to one of the nodal points, hammers for striking the respective tone bars, key-operated mechanisms for operating the respective hammers to strike the respective tone bars, a plurality of mechanical-electrical transducers each corresponding to each of said tone bars and disposed in confronting relation to said tone bars, said transducers generating electric signals in accordance with the vibration of said tone bars, and means for converting said electrical signals into musical sounds.

2. The musical instrument according to claim 1 wherein said tone bars are provided with tuning means.

3. The musical instrument according to claim 2 wherein said tuning means comprises a depression formed in the middle portion of each of said tone bars.

4. The musical instrument according to claim 2 wherein said tuning means comprises weight members secured to both ends of each of said tone bars.

5. The musical instrument according to claim 2 wherein said tuning means comprises depressions formed in both ends of each of said tone bars.

6. The musical instrument according to claim 1 wherein said first damping member has at one side facing said tone bar a triangular cross-section, the ridge of which extends across said tone bar and contacts one side of said tone bar.

7. The musical instrument according to claim 6 wherein said first damping member is penetrated by said pin.

8. The musical instrument according to claim 6 wherein said first damping member is provided with a depression in the central portion of said one side.

9. The musical instrument according to claim 8 wherein the first damping member has a hole in which said pin is loosely fitted.

10. The musical instrument according to claim 6 wherein said tone bar has in said aperture a ring-shaped shoulder which extends substantially toward the center of the aperture.

11. The musical instrument according to claim 10 wherein said shoulder is shaped in the form of an elongated ring extending in the lengthwise direction of said tone bar.

12. The musical instrument according to claim 10 wherein said second damping member comprises a funnel-shaped sleeve comprising an elastic cone portion having an outer peripheral surface contacting an edge of said shoulder and an innner peripheral surface contacting the underside surface of the head of said pin, and an elastic tube portion which is connected to said elastic cone portion and inserted in said shoulder and through which said pin is loosely fitted.

13. The musical instrument according to claim 10 wherein said second damping member has at an end facing said tone bar a triangular cross-section, the ridge of which extends across said tone bar and contacts the other side surface of said tone bar.

14. The musical instrument according to claim 10 wherein said second damping member comprises a helical coil spring wound around said pin, interposed between the head of said pin and said shoulder and adapted to elastically urge said tone bar.

15. An electrical musical instrument including:

a plurality of vibratory tone bars arranged side by side in the order of a musical scale, each of said tone bars having an aperture formed through the bar and an associated shoulder, each shoulder extending inwardly from a substantially central portion of its respective aperture, supporting means for supporting each of said tone bars at their respective nodal points with both ends of each of said tone bars left free, said supporting means for each of said tone bars comprising an elastic damping member disposed under a corresponding tone bar and having a side facing said corresponding tone bar formed in a V-shape in cross-section so as to form a ridge contacting said corresponding tone bar and extending across said corresponding tone bar, a funnel-shaped sleeve comprising an elastic tube portion inserted into said shoulder of said corresponding tone bar and an elastic cone portion having an outer peripheral surface contacted by an edge of said shoulder remote from said damping member, a pin having an intermediate portion loosely fitted in the tube portion of said sleeve and passing through said damping member, and a head provided at the other end of said pin so as to contact the underside thereof with the inner peripheral surface of the cone portion of said sleeve, hammers for striking the respective tone bars, key-operated mechanisms for operating the respective hammers to strike the respective tone bars, a plurality of mechanical-electrical transducers each corresponding to each of said tone bars and disposed in confronting relation to said tone bars, said transducers generating electric signals in accordance with the vibration of said tone bars, and means for converting said electrical signals into musical sounds.

16. The musical instrument according to claim 15, wherein said tone bars are provided with tuning means.

17. The musical instrument according to claim 16, wherein said tuning means comprises a depression formed in the middle portion of each tone bars.

18. The musical instrument according to claim 16, wherein said tuning means comprises weight members secured to both ends of each of said tone bars.

19. The musical instrument according to claim 16, wherein said tuning means comprises depressions formed in both ends of each of said tone bars.

20. An electrical musical instrument including:

a plurality of vibratory tone bars arranged side by side in the order of a musical scale, each of said tone bars having an aperture formed therethrough and an associated shoulder, each shoulder extending inwardly from a substantially central portion of its respective aperture, supporting means for supporting each of said tone bars at their respective nodal points with both ends of each of said tone bars left free, a mount for supporting each of said tone bars through said supporting means, said supporting means for each of said tone bars comprising a head member positioned opposite to said mount with respect to a corresponding tone bar, a pair of damping members disposed respectively between said head member and said corresponding tone bar and between said mount and said corresponding tone bar and having a triangular cross-section so as to form a ridge contacting said corresponding tone bar and extending across said corresponding tone bar, a sleeve inserted into said shoulder of said corresponding tone bar, a threaded pin passing through said damping members, sleeve and mount and screwed at one end in said head and at the other end in a nut mounted on the surface of said mount remote from said corresponding tone bar, hammers for striking the respective tone bars, key-operated mechanisms for operating the respective hammers to strike the respective tone bars, a plurality of mechanical-electrical transducers each corresponding to each of said tone bars and disposed in confronting relation to said tone bars, said transducers generating electric signals in accordance with the vibration of said tone bars, and means for converting said electrical signals into musical sounds.

21. An electrical musical instrument including:

a plurality of vibratory tone bars arranged side by side in the order of a musical scale, each of said tone bars having an aperture formed therethrough and an associated shoulder, each shoulder extending inwardly from a substantially central portion of its respective aperture, supporting means for supporting each of said tone bars at their respective nodal points with both ends of each of said tone bars left free, a mount carrying said supporting means, said supporting means comprising an elastic damping member disposed between a corresponding tone bar and said mount and having a side facing said corresponding tone bar provided at the central portion thereof with a depression and formed in a V-shape in cross-section at the remaining portion of said side so as to form a pair of ridges contacting said corresponding tone bar and extending across said corresponding tone bar, a bolt having one end provided with a head, an intermediate portion passing through said shoulder of said corresponding tone bar and the central portion of said damping member and the other end screwed in said mount, and a helical coil spring wound around said bolt between said shoulder of said corresponding tone bar and said head, hammers for striking the respective tone bars, key-operated mechanisms for operating the respective hammers to strike the respective tone bars, a plurality of mechanical-electrical transducers each corresponding to each of said tone bars and disposed in confronting relation to said tone bars, said transducers generating electric signals in accordance with the vibration of said tone bars, and means for converting said electrical signals into musical sounds.

22. An electrical musical instrument including:

a plurality of vibratory tone bars arranged side by side in the order of a musical scale, supporting means for supporting each of said tone bars at their respective nodal points with both ends of each of said tone bars left free, hammers for striking the respective tone bars, key-operated mechanisms for operating the respective hammers to strike the respective tone bars, a plurality of mechanical-electrical transducers each corresponding to each of said tone bars and disposed in confronting relation to said tone bars, said transducers generating electric signals in accordance with the vibration of said tone bars, means for converting said electrical signals into musical sounds, and a mount carried by a plurality of blocks which are secured to the framing of the musical instrument, said mount comprising a pair of first horizontal frame members having ends and extending crosswise of said tone bars, said horizontal frame members carrying said supporting means; a second horizontal frame member having two ends, said second horizontal frame member extending crosswise of said tone bars and in front of said first horizontal frames and holding said mechanical-electrical transducers; a pair of horizontal end frames for connecting both ends of said second horizontal member to corresponding ends of said first horizontal members; first damping elements interposed between said first horizontal frame members and said horizontal end frames; second damping elements interposed between said second horizontal frame member and said horizontal end frames; and third damping elements interposed between said horizontal end frames and said blocks which are secured to the framing of the musical instrument so as to carry said mount.

* * * * *